US005398362A

United States Patent [19]

Chauvier

[11] Patent Number: 5,398,362

[45] Date of Patent: Mar. 21, 1995

[54] FLOTATION DEVICE FOR AUTOMATIC SWIMMING POOL CLEANERS

[76] Inventor: Daniel J. V. D. Chauvier, 13801 NW. 4th St., Sunrise, Fla. 33325

[21] Appl. No.: 246,409

[22] Filed: May 20, 1994

[51] Int. Cl.[6] ..... E04H 3/20

[52] U.S. Cl. ..... 15/1.7; 15/246

[58] Field of Search ..... 15/1.7, 246; 210/169

[56] References Cited

U.S. PATENT DOCUMENTS 4,156,948 6/1979 Chauvier ..... 15/1.7

*Primary Examiner*—Edward L. Roberts

[57] ABSTRACT

Automatic swimming pool cleaners capable of cleaning the floor of a pool and also climbing and cleaning the walls of the pool utilize a flotation device of the type having a pair of interconnected float members pivotally connected to the cleaner to permit the float members to move between a position parallel to the cleaner drive tubes and a position angularly forward of the drive tubes. The improvement comprises a brace which at one end is removably connectable with the float members and at its other end abuts against a drive tube to prevent to float members from achieving the parallel position.

6 Claims, 3 Drawing Sheets

FLOTATION DEVICE FOR AUTOMATIC SWIMMING POOL CLEANERS

This invention relates to an improvement in an automatic swimming pool cleaner of the type which automatically traverses in a random manner across the floor and walls of a swimming pool, and more particularly it relates to an improvement in the flotation device which forms a part of said cleaner to keep the pool cleaner submerged and prevent it from rising above the water surface of the pool.

An automatic pool cleaner of the type to which the present invention is addressed is disclosed in U.S. Pat. No. 4,023,227, issued May 17, 1977. A cleaner of this type includes a cleaning head which is in suction contact with the pool surfaces, a pair of drive tubes extending between the head and a hose which connects to a suction source, advantageously the pool pump, and a flow valve means within the head to alternately direct water flow first to one drive tube and then the other. As the water flow to each tube is interrupted, a kinetic force is exerted upon the water in that tube. Since the tubes are angularly disposed with respect to the pool surface, the kinetic force causes the cleaner to move through a small increment of motion. These incremental movements collectively cause the cleaner to move in a random pattern across the pool floor and up the pool walls to collect the dust, dirt and debris which has accumulated thereon.

When such a pool cleaner climbs the walls of the pool, it could continue to move above the surface of the water, thereby breaking the suction and rendering the cleaner temporarily inoperative, while at the same time introducing air into the pool system. To prevent this from occurring, a flotation device is used to direct the cleaner back down toward the pool floor whenever the cleaner gets too close to the surface of the pool. A flotation device of this type is disclosed in U.S. Pat. No. 4,156,948, issued Jun. 5, 1979.

This known type of flotation device includes a pair of float members interconnected by two spaced yokes, and a pair of pivot arms connected between to float members and a bracket coupled with one of the drive tubes. The ends of the pivot arms are pivotally connected to opposite sides of the bracket. This arrangement enables the float members to move between a first position in which they are parallel to the drive tubes, disposed along the sides thereof, and a second position in which they are angularly disposed forward of the drive tubes.

When the cleaner is traversing across the floor of the swimming pool, which is generally horizontal, the drive tubes are disposed at approximately a 45 degree angle to the horizontal and the float members are pivoted to a generally vertical position. This means that the float members are angularly disposed approximately 45 degrees forwardly of the drive tubes. When the pool cleaner starts to climb up the side walls of a swimming pool, which are generally vertical, the float members tend to pivot to the aforementioned first position where they are approximately parallel to the drive tubes. As explained in the said U.S. Pat. No. 4,156,948, if the cleaner continues to climb the wall until it approaches the water surface, the float members will pivot forwardly enough to cause the cleaner to fall away from the side wall and back to the pool floor, thereby preventing the cleaner from breaking the surface of the water.

This type of pool cleaner is fully automatic in the sense that it operates whenever the pool system operates. Normally, swimming pool pumps are connected to a time clock which turns on and off at preset times, for example, "on" at 9:00 a.m. and "off" at 5:00 p.m. During this entire eight hour period while the pump operates, water will be drawn through the cleaner and the hose, as said water is alternately diverted through one drive tube, then the other, the cleaner will move randomly across the pool floor and walls, cleaning as it moves.

It has been discovered, however, that in certain types of swimming pools, there may be obstructions along the side walls of the pool which might cause the cleaner to become stuck. Such obstructions might be pool lights, return lines, ladders, and the like. While cleaners of this type normally will eventually become unstuck themselves, there are certain types of "problem" pools in which the cleaner will become stuck at a particular obstruction and be unable to detach itself. This means that the cleaner could become stuck at this one spot early in the day and could remain there for the next several hours, during which it is not performing the intended cleaning operation.

In an effort to overcome this type of problem, the present invention is addressed to an improvement which prevents pool cleaners of this type from climbing the side walls of the pool. This invention may be useful in areas such as Florida where there is relatively little dust accumulation along the pool side walls, thereby making it unimportant that the cleaner have the ability to climb the walls each day. Moreover, the present invention enables the pool owner or pool service person to temporarily disable the cleaner from climbing the walls, but to remove such disability whenever desired.

With the foregoing in mind, it is therefore an object of the present invention to provide means for selectively disabling an automatic swimming pool cleaner from being able to climb and clean the pool side walls.

It is another object of the present invention to provide an improved form of flotation device for an automatic swimming pool cleaner of the type which is capable of randomly moving across the pool floor and up the pool walls.

Another object of the present invention is to provide a motion limiting device for a flotation device of an automatic swimming pool cleaner, with the motion limiting device being capable of simple installation and removal without the need for any tools or special abilities.

Other objects, advantages, and salient features of the present invention will become apparent from the following detailed description, which taken in conjunction with annexed drawings, discloses a preferred embodiment thereof.

Referring now to the detailed drawings, which form a part of this disclosure:

Figure 1:
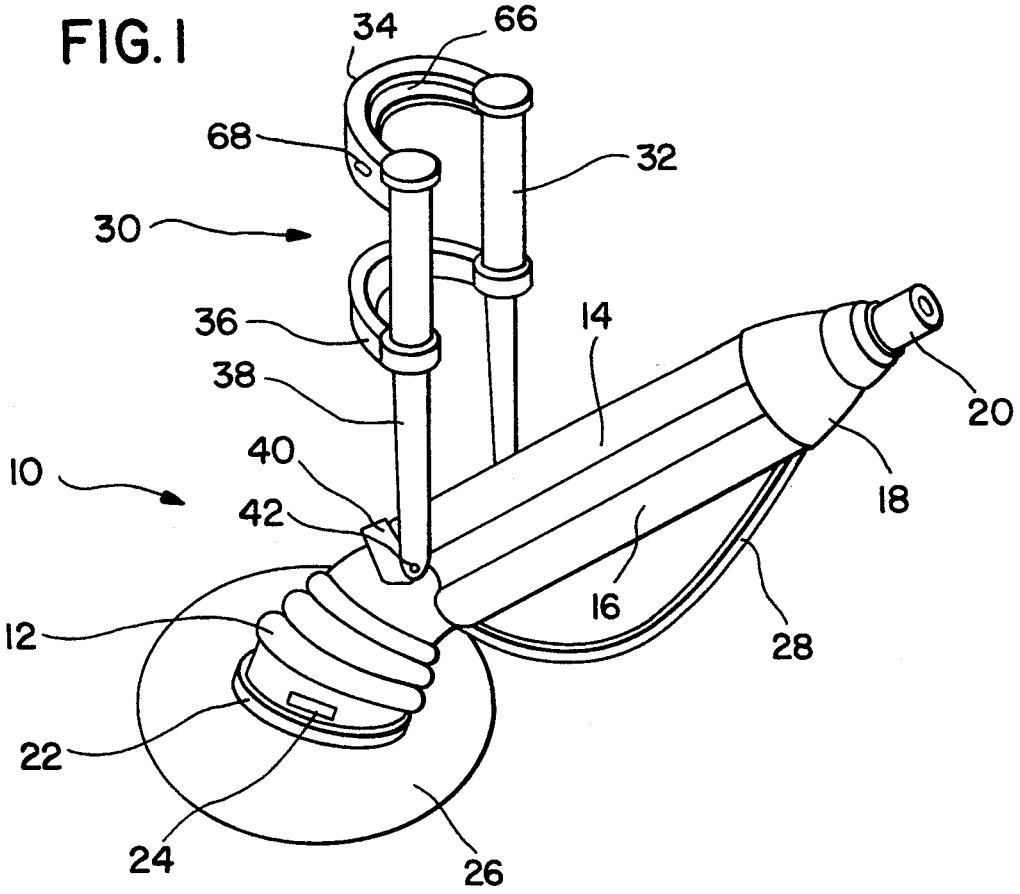
FIG. 1 shows a perspective view of a pool cleaner of this general type, with the flotation device in a first position with the float members angularly disposed forwardly of the drive tubes of the cleaner.
Figure 2:
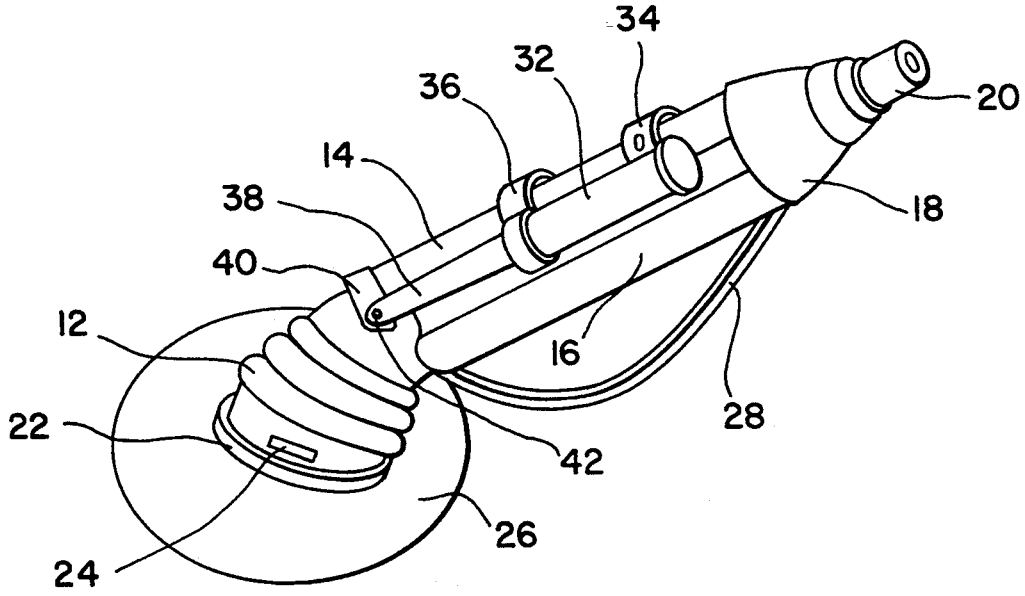
FIG. 2 is a perspective view similar to FIG. 1 but with the flotation device in a second members in a second position generally parallel to the drive tubes of the cleaner.

Referring to the drawings in greater detail, it will be understood that the automatic pool cleaner shown in FIGS. 1 and 2 is a known prior art form of cleaner, the operative details of which form no part of the present invention. Nonetheless, in order to understand the environment of the present invention, it is advantageous to disclose the general nature of such a cleaner.

The pool cleaner generally designated 10 includes a head portion 12 which connects to a pair of parallel drive tubes 14, 16 which, at their upper ends, connect to a junction member 18 having a coupling which connects to a pool hose, not shown. The head includes a foot portion 22 which is disposed at an angle of approximately 45 degrees with the axis of the drive tubes. A pair of openings 24 are provided on opposite sides of the head to permit water to be drawn into the unit under the suction influence of the pool pump which is transmitted through the hose to the upper end 20 of the cleaner. A flexible disc 26 surrounds the foot portion 22 and engages against the surface of the pool which is being cleaned by the cleaner 10. A bumper strap 28 fits behind the drive tube 16.

Figure 4:
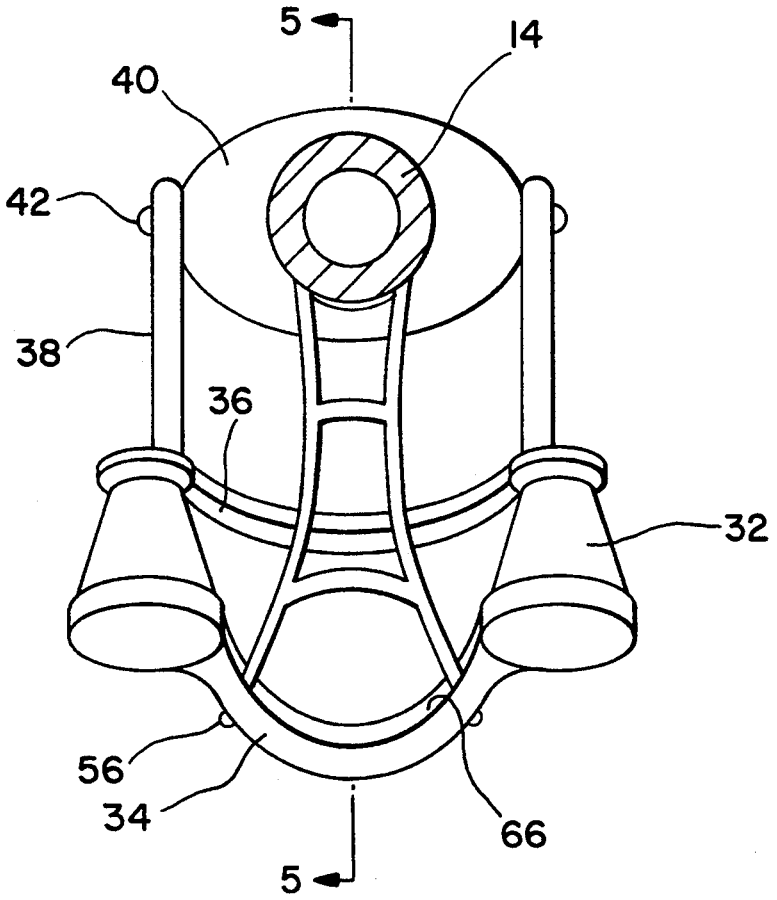
FIG. 4 is a fragmentary top view, partly in section, of the improved form of flotation device.

The cleaner includes a flotation device generally designated 30. The flotation device includes a pair of spaced parallel float members 32 in the form of hollow tubular columns. At their upper and lower ends, the float members 32 are interconnected by a pair of yokes 34 and 36, respectively. Each of these yokes is generally C-shaped in configuration, with the open part facing toward the drive tubes. Pivot arms 38 extend from the bottom of each float member 32. A bracket 40 is provided adjacent the bottom of the drive tube 14 and the lower ends of the pivot arms 38 are pivotally connected at opposite sides of the bracket by suitable pivot pins 42, as best shown in FIG. 4.

The arrangement thus far described provides a pool cleaner in which the flotation device is movable through a wide range of motion. Specifically, the float members 32 can assume a generally vertical position as shown in FIG. 1, which is the position they normally assume when the cleaner is traversing the floor of the pool. In this position, the floats are angularly disposed forwardly of the axis of the drive tubes by approximately 45 degrees. It is also possible, upon certain orientations of the cleaner 10, for the float members to move forwardly to a much greater angle, such as 90 degrees with respect to the axis of the drive tubes.

In FIG. 2, the flotation device has assumed a position in which the float members 32 are generally parallel to the axis of the drive tubes, which means that the float members are disposed along the sides of the drive tubes and the yokes 34 and 36 are in abutment against the front surface of the drive tube 14. This is the position the flotation device will often assume when the pool cleaner begins to climb up the pool walls.

Figure 3:
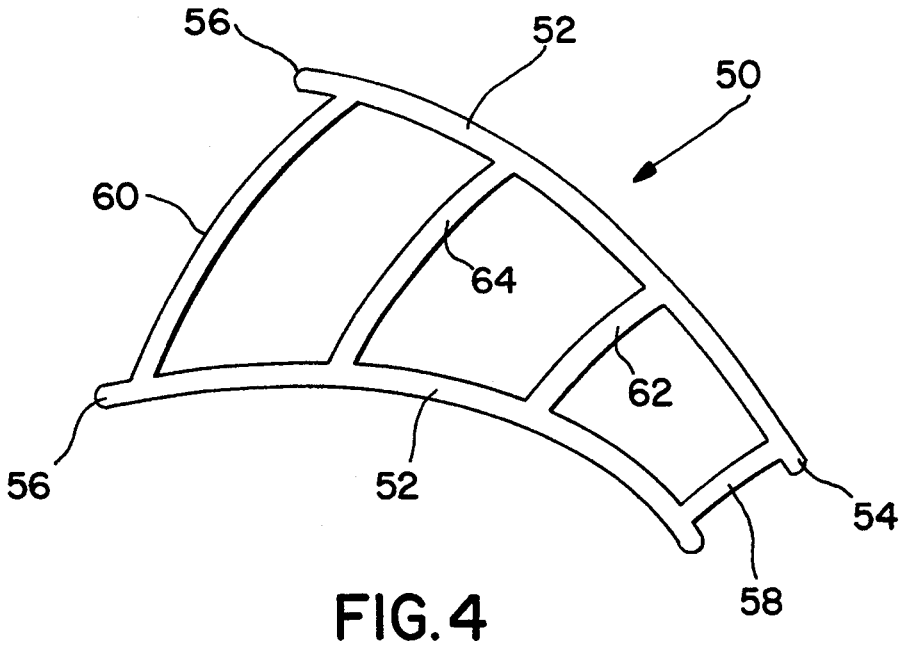
FIG. 3 is a perspective view of a brace means in accordance with the present invention.

As noted above, the present invention is an improvement which is intended to prevent the flotation device from reaching the position shown in FIG. 2, while permitting it to assume to position of FIG. 1 and even move forwardly from the FIG. 1 position. The improvement utilizes a brace means generally designated 50, as shown in FIG. 3. This brace means includes a pair of identical side arms 52 which are disposed at an angle to each other so that the inner ends 54 thereof are relatively close together and the outer ends 56 thereof are relatively wide apart. The side arms are interconnected by a transverse bar 58 adjacent their inner ends, another transverse bar 60 adjacent their outer ends, and a pair of intermediate bars 62 and 64. As can be seen, the transverse bars 58 and 60 are inset slightly from the ends of the side arms 52, thus leaving the ends 54 and 56 projecting slightly. As can best be seen from FIG. 5, the arms 52 are arcuately curved so that the inner ends are lower than the outer ends when the brace means is in position.

Figure 5:
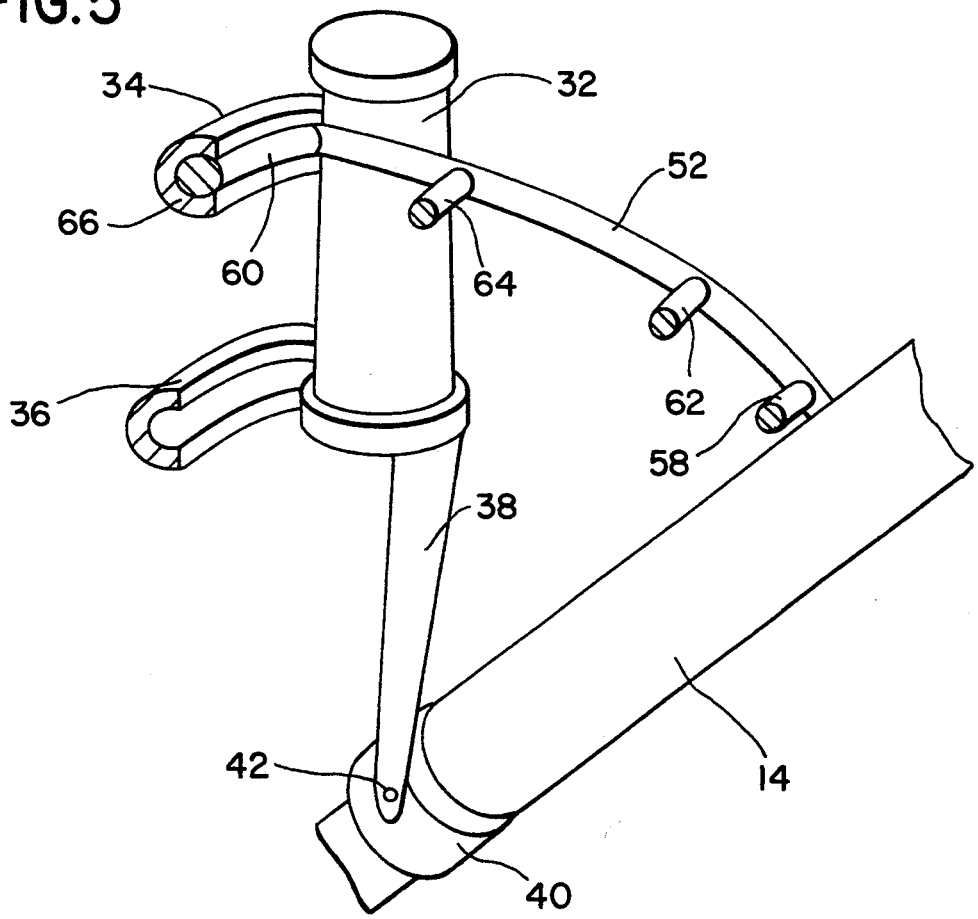
FIG. 5 is a fragmentary side elevational view, partly in section, of the improved form of flotation device, taken along the line 5—5 of FIG. 4.
Figure 6:
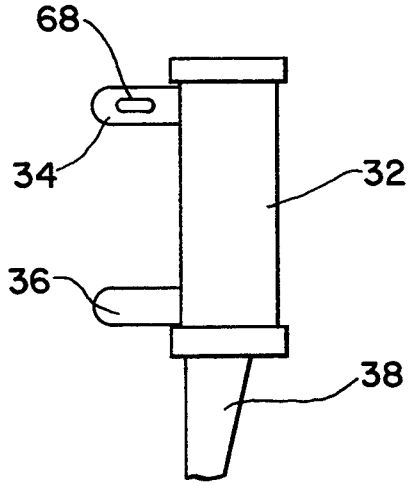
FIG. 6 is a fragmentary side elevational view of a portion of the flotation device.

The upper yoke 34 between the float members is provided with an internal channel 66 into which the transverse bar 60 is frictionally engageable, as shown in FIGS. 4 and 5. A pair of spaced apertures 68 are provided along the channel 66, as shown in FIG. 6, so the projecting ends 56 on the side arms of the brace means can fit therein.

In use, the pool owner or pool service person who wishes to fit the pool cleaner 10 with this improvement needs only to grasp the brace means 50 and insert its outer end into the channel 66 of the upper yoke 34. The brace means will remain frictionally engaged therein until it is again grasped and withdrawn from the channel. When the brace means is so inserted, as shown in FIGS. 4 and 5, the inner transverse bar 58 abuts against the front of the drive tube 14, thereby keeping the float members spaced forwardly from the drive tubes. With the brace means 50 in position, the float members 32 are prevented from assuming the position shown in FIG. 2. Thus, as the pool cleaner randomly begins to climb up the pool walls, the float members will try to move to position shown in FIG. 2. Since the brace means 50 prevents them from doing so, the cleaner will be unable to climb the pool wall and will be directed again toward the pool bottom.

This improvement is particularly useful for cleaners installed in pools where the owner is away from home for much of the time that the cleaner is running. For example, if the pool owner works Monday through Friday, he or she could install the brace means during that time to prevent the cleaner from becoming stuck on a protrusion along the pool side wall during his or her absence. Then, on the weekend when the owner is home, it is a quick and simple matter to remove the brace means 50 to enable to cleaner to climb and clean the pool side walls. If the cleaner happens to become stuck while doing so, the owner is available to quickly move the cleaner to unstick it.

After reading the foregoing detailed description, it should be apparent that the objects set forth at the outset hereof are successfully achieved by the present invention. Various changes or modifications apparent to those skilled in the art may be made without departing from the spirit and scope of the present invention, as defined in the appended claims.

What is claimed is:

1. In an automatic swimming pool cleaner of the type which automatically traverses in a random manner across the floor and walls of the pool, said cleaner having (a) a pair of elongated drive tubes connectable via a hose to a suction source, (b) a flow valve means to alternately divert flow first to one tube and then to the other, and (c) a flotation device coupled with the cleaner to keep said cleaner submerged and prevent it rising above the water surface of the pool, said flotation device comprising:

a pair of buoyant float members;

said float members being interconnected by a pair of spaced yokes attached to said float members adjacent the top and bottom thereof;

lever arms extending from the bottom of each of said float members;

a bracket coupled with one of said drive tubes;

said lever arms being pivotally attached to said bracket to enable said float members pivot toward and away from said drive tubes depending upon the spatial orientation of the cleaner within the pool water;

the improvement which comprises:

motion limiting means removably connectable with flotation device to limit the degree of pivotal movement of said float members toward said drive tubes while permitting pivotal movement of said float members away from said drive tubes;

said motion limiting means assuring that said float members cannot move into a position parallel to said drive tubes.

2. The improvement defined in claim 1 wherein said motion limiting means comprises a brace means.

3. The improvement defined in claim 2 wherein at least one of said yokes has an internal channel formed therein and wherein said brace means has a forward end which is releasably engageable within said channel.

4. The improvement defined in claim 3 wherein said brace means further includes a rear end opposite said forward end, said rear end being engageable against a drive tube to prevent further pivotal movement of said float members toward said drive tube.

5. The improvement defined in claim 4 wherein said brace means is arcuately curved between its forward and rear ends whereby the forward end of said brace means is higher along said cleaner than the rear end of said brace means.

6. The improvement defined in claim 3 wherein said channel has a pair of spaced apertures therein and wherein said forward end of said brace means includes a pair of projections which fit within said apertures when said forward end of said brace means is engaged within said channel.

* * * * *